US011780230B2

(12) United States Patent
Atake et al.

(10) Patent No.: US 11,780,230 B2
(45) Date of Patent: Oct. 10, 2023

(54) WIPER, WIPING DEVICE, LIQUID DISCHARGE APPARATUS, AND WIPING METHOD

(71) Applicant: RICOH COMPANY, LTD., Tokyo (JP)

(72) Inventors: Takumi Atake, Tokyo (JP); Yohta Sakon, Kanagawa (JP); Hiroko Ohkura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 169 days.

(21) Appl. No.: 17/417,988

(22) PCT Filed: Dec. 20, 2019

(86) PCT No.: PCT/JP2019/050133

§ 371 (c)(1),
(2) Date: Jun. 24, 2021

(87) PCT Pub. No.: WO2020/137900

PCT Pub. Date: Jul. 2, 2020

(65) Prior Publication Data

US 2022/0009233 A1 Jan. 13, 2022

(30) Foreign Application Priority Data

Dec. 26, 2018 (JP) ..... 2018-242079

(51) Int. Cl.
*B41J 2/165* (2006.01)

(52) U.S. Cl.
CPC ..... *B41J 2/16535* (2013.01); *B41J 2/16552* (2013.01); *B41J 2002/1655* (2013.01); *B41J 2002/16558* (2013.01)

(58) Field of Classification Search
CPC ..... B41J 2/16535; B41J 2/16552; B41J 2002/1655; B41J 2002/16558
See application file for complete search history.

(56) References Cited

U.S. PATENT DOCUMENTS

2004/0099388 A1 5/2004 Chen et al.
2005/0225593 A1 10/2005 Ito et al.
(Continued)

FOREIGN PATENT DOCUMENTS

CN 102858468 1/2013
CN 104070812 10/2014
(Continued)

OTHER PUBLICATIONS

Chinese Office Action dated Sep. 19, 2022, in Chinese Application No. 201980086115.8, 8 pages.
(Continued)

*Primary Examiner* — Sharon Polk
(74) *Attorney, Agent, or Firm* — Grüneberg and Myers PLLC

(57) ABSTRACT

A wiper for wiping a nozzle surface of a liquid discharge head that discharges liquid from the nozzle is provided. The wiper comprises a plurality of layers including at least a first layer, and the first layer has a surface that contacts the nozzle surface. The surface that contacts the nozzle surface has a maximum height of waviness Wz of from 100 to 600 μm.

15 Claims, 4 Drawing Sheets

(56) References Cited

U.S. PATENT DOCUMENTS

| | | | |
|---|---|---|---|
| 2010/0053260 | A1 | 3/2010 | Burmeister et al. |
| 2014/0292919 | A1 | 10/2014 | Kobayashi et al. |
| 2017/0119226 | A1 | 5/2017 | Nakayama et al. |
| 2017/0151789 | A1 | 6/2017 | Yamanobe |
| 2018/0178526 | A1* | 6/2018 | Leia ..... B41J 2/16585 |
| 2018/0208783 | A1 | 7/2018 | Takahashi et al. |
| 2018/0264821 | A1 | 9/2018 | Sato et al. |
| 2019/0283430 | A1 | 9/2019 | Atake |

FOREIGN PATENT DOCUMENTS

| | | |
|---|---|---|
| CN | 106661787 | 5/2017 |
| CN | 108340676 | 7/2018 |
| CN | 108621582 | 10/2018 |
| JP | 2011-000891 | 1/2011 |
| JP | 2014-188900 A | 10/2014 |
| JP | 2019-147262 A | 9/2019 |

OTHER PUBLICATIONS

International Search Report and Written Opinion dated Apr. 1, 2020 in PCT/JP2019/050133 filed on Dec. 20, 2019.
Chinese Office Action dated Mar. 30, 2022 in Chinese Application No. 201980086115.8, 8 pages.

* cited by examiner

WIPER, WIPING DEVICE, LIQUID DISCHARGE APPARATUS, AND WIPING METHOD

TECHNICAL FIELD

The present disclosure relates to a wiper, a wiping device, a liquid discharge apparatus, and a wiping method.

BACKGROUND ART

A liquid discharge apparatus, represented by an inkjet printer, needs regular cleaning because discharge failure may occur when foreign matters are present on its nozzle surface. One known method for cleaning the nozzle surface involves using sheet-like wipers such as a nonwoven fabric and a woven fabric in combination.

Patent Document 1 discloses a wiper device that relatively moves a wiper and a liquid ejecting head that ejects from a nozzle a dispersion liquid dispersing solid particles in a liquid, so that the dispersion liquid adhered to the nozzle surface is removed by the wiper. This wiper has a first layer on the nozzle surface side and a second layer on the opposite side of the nozzle surface with respect to the first layer. The first layer has voids capable of guiding droplets, which are the dispersion medium of the dispersion liquid adhered to the nozzle surface, to the second layer by capillary action, and further capturing and accommodating the dispersoid of the dispersion liquid. The second layer absorbs the dispersion medium.

CITATION LIST

Patent Literature

PTL 1: Japanese Unexamined Patent Application Publication No. 2014-188900

SUMMARY OF INVENTION

Technical Problem

However, such a cleaning method using the conventional wiper has difficulty in removing fixedly-adhered matter on the nozzle surface resulted from the liquid having been dried. In addition, after the wiper has wiped the nozzle surface, unstable discharging or non-discharging may occur upon discharging of liquid from the nozzle, which exerts an influence on discharge reliability.

Solution to Problem

In accordance with some embodiments of the present invention, a wiper for wiping a nozzle surface of a liquid discharge head that discharges liquid from the nozzle is provided. The wiper comprises a plurality of layers including at least a first layer, and the first layer has a surface that contacts the nozzle surface. The surface that contacts the nozzle surface has a maximum height of waviness Wz of from 100 to 600 μm.

Advantageous Effects of Invention

The wiper according to some embodiments of the present invention has an excellent effect of easily removing fixedly-adhered matter on the nozzle surface resulted from the liquid having been dried, and another excellent effect of improving discharge reliability in discharging liquid from the nozzle after the nozzle surface has been wiped with the wiper.

BRIEF DESCRIPTION OF DRAWINGS

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

Figure 1:
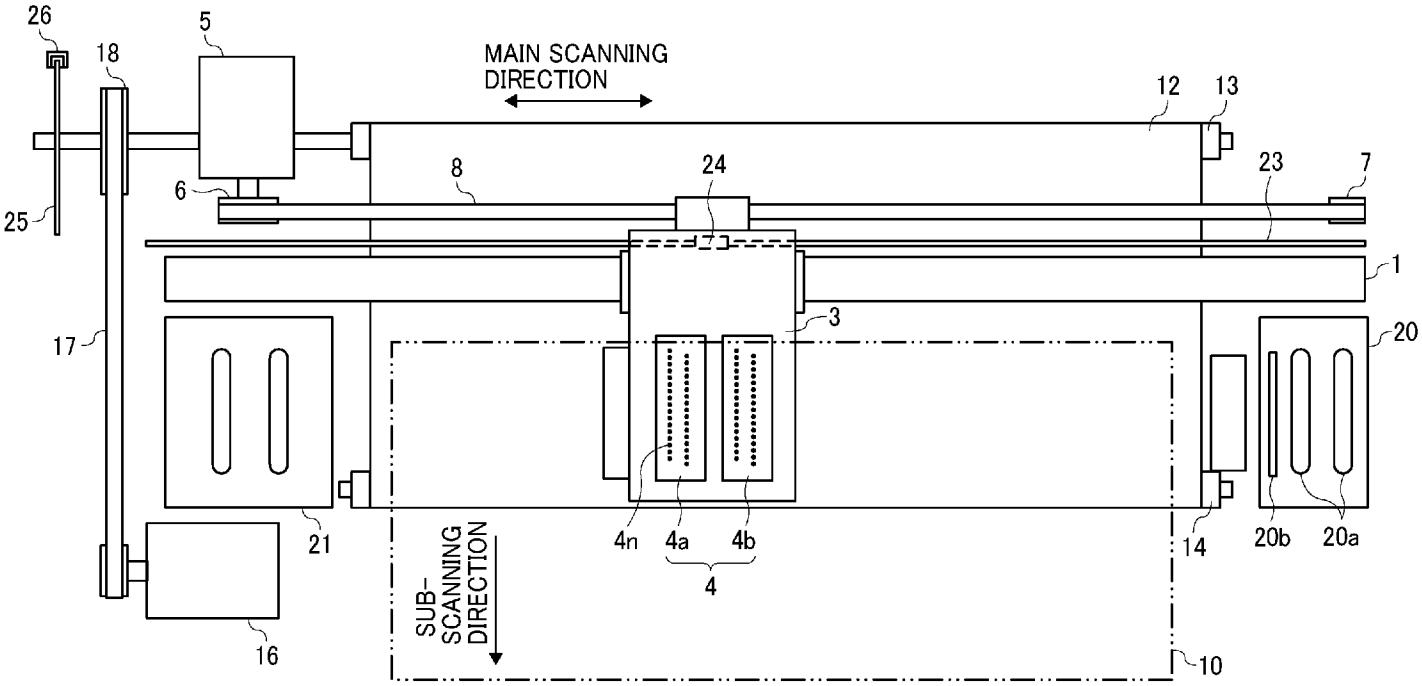
FIG. 1 is a schematic diagram illustrating an image forming apparatus incorporating a wiping device according to an embodiment of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present invention are described.

Image Forming Apparatus, Wiping Device, and Wiping Method

The wiping device includes the wiper according to the present embodiment and may further include other members such as a cleaning fluid, as necessary. The wiping method that is performed by the wiping device includes a wiping process and may further include other processes such as a cleaning fluid applying process, as necessary. The wiping device wipes a nozzle surface of a liquid discharge head that discharges liquid from the nozzle by bringing the wiper into contact with the nozzle surface. Preferably, when the wiper wipes the nozzle surface, the nozzle surface has been applied with a cleaning fluid. In the present disclosure, "wiping" refers to relative movement between the wiper and the liquid discharge head with the wiper and the nozzle surface in contact with each other. By wiping the nozzle surface with the wiper according to the present embodiment, the wiper is capable of removing fixedly-adhered matter on the nozzle surface resulted from the liquid having been dried. Furthermore, the wiper is capable of absorbing an excess liquid overflowing from the nozzle to remove it from the nozzle surface.

Figure 2:
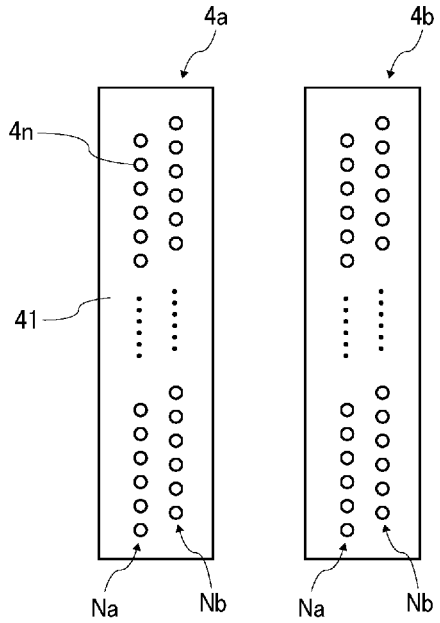
FIG. 2 is a schematic diagram illustrating a nozzle surface of a liquid discharge head.
Figure 3:
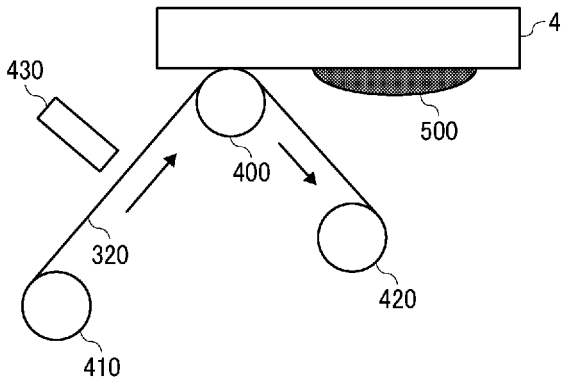
FIG. 3 is a schematic diagram illustrating a wiping device according to an embodiment of the present invention.

The wiping device is described in detail below with reference to FIGS. 1 to 3. An image forming apparatus illustrated in FIG. 1 is one example of the liquid discharge apparatus incorporating the wiping device. This image forming apparatus discharges an ink as an example of the liquid. FIG. 1 is a schematic diagram illustrating the image forming apparatus incorporating the wiping device. FIG. 2 is a schematic diagram illustrating the nozzle surface of the liquid discharge head. FIG. 3 is a schematic diagram illustrating the wiping device.

The image forming apparatus illustrated in FIG. 1 is a serial-type liquid discharge apparatus. A carriage 3 is movably held by a main guide 1 laterally bridged between left and right side plates and a sub-guide. A main scanning motor 5 reciprocates the carriage 3 in the main scanning direction (carriage moving direction) via a timing belt 8 bridged between a drive pulley 6 and a driven pulley 7. On the carriage 3, recording heads 4*a* and 4*b* (hereinafter each "recording head 4" when not distinguished), serving as liquid discharge heads, are mounted. The recording head 4 discharges ink droplets of, for example, yellow (Y), cyan (C), magenta (M), or black (K). The recording head 4 has nozzle arrays each comprising a plurality of nozzles, arranged in the sub-scanning direction that is orthogonal to the main scanning direction. The recording head 4 is mounted with its droplet discharging direction downward.

As illustrated in FIG. 2, the recording head 4 has a nozzle surface 41 having two nozzle arrays Na and Nb in each of which a plurality of nozzles 4*n* are arranged. Examples of the liquid discharge head constituting the recording head 4 include, but are not limited to, a piezoelectric actuator such as a piezoelectric element, and a thermal actuator that utilizes phase change of a liquid caused by film boiling using an electrothermal conversion element such as a heat element.

The image forming apparatus illustrated in FIG. 1 is further equipped with a conveyance belt 12 that electrostatically attracts a sheet 10 to convey the sheet 10 to a position facing the recording head 4. The conveyance belt 12 is an endless belt stretched between a conveyance roller 13 and a tension roller 14. The conveyance belt 12 circumferentially moves in the sub-scanning direction as the conveyance roller 13 is rotationally driven by a sub-scanning motor 16 via a timing belt 17 and a timing pulley 18. The conveyance belt 12 is charged by a charging roller while circumferentially moving.

On one side of the carriage 3 in the main scanning direction, a maintenance mechanism 20 for maintaining the recording heads 4 is disposed lateral to the conveyance belt 12. On the other side, a dummy discharge receptacle 21 for receiving dummy discharge from the recording heads 4 is disposed lateral to the conveyance belt 12. The maintenance mechanism 20 includes caps 20*a* for capping the nozzle surface (surface on which the nozzles are formed) of the recording head 4, a nozzle surface wiping mechanism 20*b* for wiping the nozzle surface, and a dummy discharge receptacle to which liquid droplets not contributing to image formation are discharged.

The image forming apparatus is further equipped with an encoder scale 23 having a specific pattern thereon, stretched between both side plates along the main scanning direction of the carriage 3. The carriage 3 is provided with an encoder sensor 24 comprising a transmissive photosensor that reads the pattern on the encoder scale 23. The encoder scale 23 and the encoder sensor 24 configure a linear encoder (main scanning encoder) that detects movement of the carriage 3.

A code wheel 25 is mounted on the shaft of the conveyance roller 13, and an encoder sensor 26 comprising a transmissive photosensor that detects a pattern formed on the code wheel 25 is provided thereto. The code wheel 25 and the encoder sensor 26 configure a rotary encoder (sub-scanning encoder) that detects the amount of movement and the position of the conveyance belt 12.

In this image forming apparatus, the sheet 10 is fed and attracted onto the charged conveyance belt 12. The sheet 10 is then conveyed in the sub-scanning direction by circumferential movement of the conveyance belt 12. By driving the recording heads 4 in response to an image signal while moving the carriage 3 in the main-scanning direction, ink droplets are discharged onto the sheet 10 not in motion, thus recording one line portion. The sheet 10 is thereafter conveyed for a specified distance and a next line portion is recorded thereon. In response to a recording end signal or a signal indicating that the rear end of the sheet 10 has reached a recording area, the recording operation is ended and the sheet 10 is ejected onto an output tray.

To clean the recording heads 4, the carriage 3 is moved to the maintenance mechanism 20 during a waiting time for printing (recording), and the cleaning is performed by the maintenance mechanism 20. Alternatively, the cleaning may be performed by moving the maintenance mechanism 20 without moving the recording heads 4. The recording head 4 illustrated in FIG. 1 have two nozzle arrays Na and Nb in each of which a plurality of nozzles 4*n* are arranged, as illustrated in FIG. 2. The nozzle array Na of the recording head 4*a* discharges droplets of black (K), and the other nozzle array Nb discharges droplets of cyan (C). The nozzle array Na of the recording head 4*b* discharges droplets of magenta (M), and the other nozzle array Nb discharges droplets of yellow (Y).

The nozzle surface wiping mechanism 20*b* is one example of the wiping device. As illustrated in FIG. 3, the nozzle surface wiping mechanism 20*b* includes a sheet-like wiper 320 (serving as the wiper), a feed roller 410 that feeds out the sheet-like wiper 320 in a conveying direction (indicated by arrows in FIG. 3), a cleaning fluid dropping device 430 (serving as a cleaning fluid applicator) that performs a cleaning fluid applying process by applying a cleaning fluid to the sheet-like wiper 320 fed, a pressing roller 400 (serving as a presser) that presses the sheet-like wiper 320 applied with the cleaning fluid against the nozzle surface, and a winding roller 420 that collects the sheet-like wiper 320 used for wiping. The cleaning fluid is supplied from a cleaning fluid container containing the cleaning fluid through a cleaning fluid supply tube provided with a pump for supplying the cleaning fluid. The nozzle surface wiping mechanism 20*b* may further include a rubber blade or the like for wiping the nozzle surface in addition to the sheet-like wiper 320. The pressing roller 400 can adjust the pressing force by adjusting the distance between the sheet-like wiper 320 and the nozzle surface with a spring. The presser is not limited to be in the form of a roller and may be a fixed resin or a rubber member. In a case in which a rubber blade is provided, a mechanism for abutting the rubber blade on the sheet-like wiper 320 may be provided to impart a function of cleaning the rubber blade to the sheet-like wiper 320. Form the viewpoint of miniaturization, the sheet-like wiper is preferably housed in a roll-up state, as illustrated in FIG. 3, but may also be housed in a folded state. The cleaning fluid applicator is not limited to the cleaning fluid dropping device and may be a cleaning fluid applying roller that applies the cleaning fluid with a roller or a cleaning fluid applying spray that sprays the cleaning fluid with a spray. Further, the cleaning fluid applying process performed by the cleaning fluid applicator is not particularly limited as long as the cleaning fluid is applied to the nozzle surface. The cleaning fluid applying process may be either a process in which the cleaning fluid is indirectly applied via the cleaning fluid applicator, as in the above-described embodiment, or a process in which the cleaning fluid is directly applied to the nozzle surface, but the former (i.e., a process in which the cleaning fluid is indirectly applied via the cleaning fluid applicator) is more preferred.

In the present embodiment, the wiping process includes applying a certain amount of the cleaning fluid to the wiper and thereafter moving the nozzle surface wiping mechanism 20*b* and the recording head 4 relative to each other with the wiper pressed against the nozzle surface, so that foreign matter 500 adhered to the nozzle surface is wiped off. Examples of the foreign matter 500 adhered to the nozzle surface include, but are not limited to, mist ink generated when ink is discharged from the nozzle, ink adhering to the nozzle surface when ink is sucked from the nozzle during cleaning, fixedly-adhered ink that is mist ink or ink adhering to the cap having been dried on the nozzle surface, and paper dust generated from print medium. In the present embodiment, wiping off of the foreign matter 500 is performed after the wiper that does not contain the cleaning fluid is applied with the cleaning fluid. Alternatively, the wiper containing the cleaning liquid in advance may be used without using the cleaning fluid applicator. Further, the cleaning fluid may be applied to a portion other than the wiper. For example, the cleaning fluid may be directly applied to the nozzle surface. Accordingly, the "cleaning fluid applied to the nozzle surface" refers to all types of cleaning fluids finally applied to the nozzle surface. Examples thereof include a cleaning fluid directly applied to the nozzle surface and a cleaning fluid indirectly applied to the nozzle surface via the wiper containing the cleaning fluid, and the latter (i.e., a cleaning fluid indirectly applied to the nozzle surface via the wiper containing the cleaning fluid) is more preferred. In a case in which it is assumed that the ink has been dried and fixedly-adhered to the nozzle surface due to a long standby state, it is preferable that the fixedly-adhered ink is removed by wiping the nozzle surface multiple times with the wiper containing the cleaning fluid. Although it is preferable that the nozzle surface is wiped with the wiper using the cleaning fluid, the nozzle surface may also be wiped with the wiper without using the cleaning fluid.

Wiper

Figure 4:
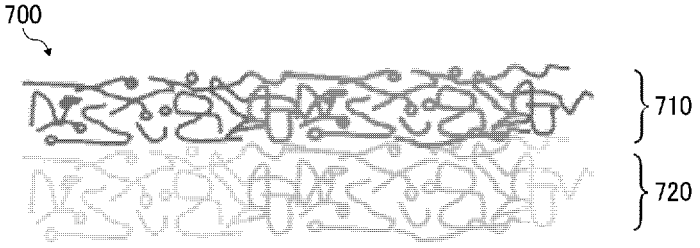
FIG. 4 is a schematic cross-sectional diagram illustrating a sheet-like wiper

Next, the wiper is described in detail with reference to FIG. 4. FIG. 4 is a schematic cross-sectional diagram illustrating a sheet-like wiper. A wiper 700 illustrated in FIG. 4 is comprised of a two-layer nonwoven fabric having a first layer 710 and a second layer 720. The first layer 710 has a surface that contacts the nozzle surface of the liquid discharge head to wipe the nozzle surface. The second layer 720 (other than the first layer 710) has a back surface that does not contact the nozzle surface. Alternatively, the wiper may be in a three-layer structure in which the wiper is backed with a film for preventing the bleed-through of the absorbed ink and improving the strength of the wiper, or a multi-layer structure in which a plurality of absorption layers having different absorbabilities are provided after the second layer. Thus, the wiper is in a layered structure having at least one layer other than the first layer.

The surface of the wiper that contacts the nozzle surface (i.e., the surface of the first layer that contacts the nozzle surface) has a maximum height of waviness Wz of from 100 to 600 μm, preferably from 150 to 300 μm. By wiping the nozzle surface with the wiper having a maximum height of waviness Wz of from 100 to 600 μm, discharge reliability is improved without impairing wiping property. The maximum height of waviness Wz can be obtained by, for example, a laser microscope (LEXT OLS4100 available from OLYMPUS CORPORATION). A method for obtaining the maximum height of waviness Wz using this laser microscope (LEXT OLS4100 available from OLYMPUS CORPORATION) is described below. First, a primary profile of the wiper is acquired. Here, the primary profile refers to a curve constituting a part of a surface of the wiper, which is present on an orthogonal surface that is orthogonal to the conveying direction of the wiper, and which contacts the nozzle surface. The length of the primary profile to be evaluated in the measurement may be, for example, 2.5 mm. Next, according to JIS (Japanese Industrial Standards) B0601 (2013), a waviness profile is obtained by cutting off short wavelength components from the primary profile under a profile filter condition of $\lambda c=80$ μm. The maximum height of waviness Wz is the sum of the maximum profile peak height (Zp) and the maximum profile valley depth (Zv) in the waviness profile. It is preferable that the entire surface of the wiper that contacts the nozzle surface has a maximum height of waviness Wz of from 100 to 600 μm, but it is also possible that a part of the surface of the wiper that contacts the nozzle surface has a maximum height of waviness Wz of from 100 to 600 μm.

The surface of the wiper that contacts the nozzle surface (i.e., the surface of the first layer that contacts the nozzle surface) preferably has a maximum height of roughness Rz of from 170 to 500 μm. By wiping the nozzle surface with the wiper having a maximum height of roughness Rz of from 170 to 500 μm, discharge reliability is improved. The maximum height of roughness Rz can be obtained by, for example, a laser microscope (LEXT OLS4100 available from OLYMPUS CORPORATION). A method for obtaining the maximum height of roughness Rz using this laser microscope (LEXT OLS4100 available from OLYMPUS CORPORATION) is described below. First, a primary profile of the wiper is acquired. Here, the primary profile refers to a curve constituting a part of a surface of the wiper, which is present on an orthogonal surface that is orthogonal to the conveying direction of the wiper, and which contacts the nozzle surface. The length of the primary profile to be evaluated in the measurement may be, for example, 2.5 mm. Next, according to JIS (Japanese Industrial Standards) B0601 (2013), a roughness profile is obtained by cutting off long wavelength components from the primary profile under a profile filter condition of $\lambda c=80$ μm. The maximum height of roughness Rz is the sum of the maximum profile peak height (Zp) and the maximum profile valley depth (Zv) in the roughness profile. It is preferable that the entire surface of the wiper that contacts the nozzle surface has a maximum height of roughness Rz of from 170 to 500 μm, but it is also possible that a part of the surface of the wiper that contacts the nozzle surface has a maximum height of roughness Rz of from 170 to 500 μm.

Examples of the material constituting the wiper include woven fabrics, knitted fabrics, and porous bodies, in addition to nonwoven fabrics. In particular, nonwoven fabrics are preferred because it is relatively easily to control the thickness and void ratio and to blend with various types of fibers. Examples of the materials constituting fibers such as nonwoven fabrics, woven fabrics, and knitted fabrics include, but are not limited to, cotton, hemp, silk, pulp, nylon, vinylon, polyester, polypropylene, polyethylene, rayon, cupro, acrylic, and polylactic acid. The nonwoven fabric may be comprised of either one type of fiber or multiple types of fibers mixed. Examples of the porous bodies include, but are not limited to, polyurethane, polyolefin, and PVA. One example method of producing the wiper is described below, referring to a case in which the wiper is comprised of a nonwoven fabric. The nonwoven fabric may be formed by various methods such as wet, dry, spunbond, meltblown, and flash spinning methods. Moreover, the nonwoven fabric may be bonded by various methods such as spunlace, needle punch, thermal bond, and chemical bond methods. The spunlace method is a method in which a jet water stream is sprayed on the deposited fibers to entangle the fibers with each other by the pressure and to bond them in a sheet form. The needle punch method is a method in which the deposited fibers are pierced several tens of times or more with a needle having protrusions called barbs, so that the fibers are mechanically entangled with each other and processed into a nonwoven fabric.

When the void ratio of the first layer is smaller than the void ratio of at least one layer other than the first layer, the ability for scraping off fixedly-adhered ink is improved, and wiping property for removing fixedly-adhering ink is improved. Here, the void ratio is calculated as follows.

$$\text{VOID RATIO} = 1 - \frac{\text{APPARENT DENSITY}}{\text{TRUE DENSITY}} \qquad \text{FORMULA (1)}$$

In the case of a sheet-like nonwoven fabric, the "true density" represents the true density of the fiber forming the sheet, and the "apparent density" is calculated by dividing the basis weight by the thickness of the sheet-like material.

The ability of the wiper for scraping off fixedly-adhered ink is improved as the thickness becomes small and the void ratio becomes small. However, when the thickness is small and the void ratio is small, it becomes difficult for the wiper to retain liquid components such as ink and cleaning fluid, and as a result, the cleaning property becomes insufficient with a single layer. For this reason, it is preferable that a layer capable of retaining liquid components is provided other than the first layer. Further, as described above, when the void ratio of the first layer is smaller than the void ratio of at least one layer other than the first layer, wiping property for removing fixedly-adhered ink is improved. Furthermore, when the void ratio of the first layer is smaller than the void ratios of all the layers other than the first layer, wiping property for removing fixedly-adhered ink is more improved. In addition, it is preferable that the thickness of the first layer is smaller than the total thickness of the layers other than the first layer. In this case, wiping property for removing fixedly-adhered ink is more improved.

The void ratio of the first layer is preferably from 0.70 to 0.85, and more preferably from 0.75 to 0.80. When the void ratio of the first layer is from 0.70 to 0.85, wiping property for removing fixedly-adhered ink is improved, and the wiper is improved in permeability without becoming a film-like shape that does not permeate liquids.

The void ratio of at least one layer other than the first layer is preferably from 0.80 to 0.99. When the void ratio of at least one layer other than the first layer is within the above range, liquid absorbability is improved. As the first layer is combined with such a layer other than the first layer, both the ability for scraping off fixedly-adhered ink and the liquid absorbability are achieved at the same time, and thus wiping property is improved. It is more preferable that the void ratios of all the layers other than the first layer are within the above-described range.

Preferably, the wiper has a thickness of from 0.1 to 3.0 mm. When the thickness of the wiper is 0.1 mm or more, the saturated water absorption amount for liquid per pre-determined area of the wiper is sufficient to sufficiently absorb the ink to be wiped off. When the thickness of the wiper is 3.0 mm or less, the liquid component of the ink is suitably transferred from the first layer to a layer other than the first layer without impairing the liquid absorbability of the layer other than the first layer, thus making it possible to downsize the apparatus.

Cleaning Fluid

The cleaning fluid that may be mounted on the wiping device preferably contains a compound represented by the general formula (1) below and a glycol ether compound. The cleaning fluid may further contain other organic solvents, water, a surfactant, a defoamer, a preservative and fungicide, a rust preventive, and/or a pH adjuster, as necessary. When the cleaning fluid is directly or indirectly applied to the nozzle surface first and then the nozzle surface is wiped with the wiper, fixedly-adhered matter formed on the nozzle surface can be easily removed because the viscosity thereof has been reduced. It is preferable that the cleaning fluid is contained in a container and mounted on the wiping device.

Compound Represented by General Formula (1)

The cleaning fluid preferably contains a compound represented by the general formula (1) below. By containing the compound represented by the general formula (1), the cleaning fluid well dissolves fixedly-adhered matter (e.g., ink film) formed as a liquid (e.g., ink) has been dried. In addition, the cleaning fluid well permeates the fixedly-adhered matter.

[Chem. 1]

GENERAL FORMULA (1)

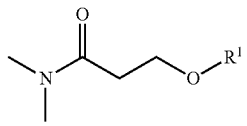

In the general formula (1), $R^1$ represents an alkyl group having 1 to 4 carbon atoms, such as methyl group, ethyl group, propyl group, and butyl group. Examples of the compound represented by the general formula (1) include, but are not limited to, 3-methoxy-N,N-dimethylpropionamide (when $R^1$ is methyl group) and 3-butoxy-N,N-dimethylpropionamide (when $R^1$ is butyl group). Preferably, the proportion of the compound represented by the general formula (1) in the cleaning fluid is from 20.0% to 60.0% by mass. When the proportion of the compound represented by the general formula (1) is within the above range, cleaning property of the cleaning fluid is improved.

Glycol Ether Compound

The cleaning fluid preferably contains a glycol ether compound. By containing the glycol ether compound, the cleaning fluid well dissolves fixedly-adhered matter (e.g., ink film) formed as a liquid (e.g., ink) has been dried. In addition, the cleaning fluid well permeates the fixedly-adhered matter. Examples of the glycol ether include, but are not limited to, ethylene glycol monobutyl ether, propylene glycol monomethyl ether, propylene glycol monobutyl ether, diethylene glycol monoethyl ether, diethylene glycol monobutyl ether, diethylene glycol methyl ethyl ether, dipropylene glycol monomethyl ether, dipropylene glycol monoethyl ether, propylene glycol n-propyl ether, triethylene glycol monomethyl ether, triethylene glycol monoethyl ether, triethylene glycol monobutyl ether, and tripropylene glycol monomethyl ether. Each of these materials may be used alone or in combination with others.

The proportion of the glycol ether compound in the cleaning fluid is preferably from 1.0% to 30.0% by mass, and more preferably from 1.0% to 10.0% by mass. When the proportion of the glycol ether compound is within the above range, both cleaning property and discharge stability of the cleaning fluid are achieved at the same time.

Preferably, the cleaning fluid contains the compound represented by the general formula (1) and the glycol ether compound in combination. The combined use of these materials improves wiping property. Preferably, the content ratio of the compound represented by the general formula (1) to the glycol ether compound (the compound represented by the general formula (1)/the glycol ether compound) is from 1.0 to 7.0.

Organic Solvent

Organic solvents that may be contained in the cleaning fluid are not particularly limited, and water-soluble organic solvents may be used. Examples thereof include, but are not limited to, polyols, ethers such as polyol alkyl ethers and polyol aryl ethers, nitrogen-containing heterocyclic compounds, amides, amines, and sulfur-containing compounds.

Specific examples of the polyols include, but are not limited to, ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and 3-methyl-1,3,5-pentanetriol.

Specific examples of the polyol alkyl ethers include, but are not limited to, ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Specific examples of the polyol aryl ethers include, but are not limited to, ethylene glycol monophenyl ether and ethylene glycol monobenzyl ether.

Specific examples of the nitrogen-containing heterocyclic compounds include, but are not limited to, 2-pyrrolidone, N-methyl-2-pyrrolidone, N-hydroxyethyl-2-pyrrolidone, 1,3-dimethyl-2-imidazolidinone, ε-caprolactam, and γ-butyrolactone.

Specific examples of the amides include, but are not limited to, formamide, N-methylformamide, and N,N-dimethylformamide.

Specific examples of the amines include, but are not limited to, monoethanolamine, diethanolamine, and triethylamine.

Specific examples of the sulfur-containing compounds include, but are not limited to, dimethylsulfoxide, sulfolane, and thiodiethanol.

Specific examples of other organic solvents include, but are not limited to, propylene carbonate and ethylene carbonate.

Preferred examples of organic solvents further include polyol compounds having 8 or more carbon atoms and glycol ether compounds. Specific examples of the polyol compounds having 8 or more carbon atoms include, but are not limited to, 2-ethyl-1,3-hexanediol and 2,2,4-trimethyl-1,3-pentanediol.

Specific examples of the glycol ether compounds include, but are not limited to, polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyol aryl ethers such as ethylene glycol monophenyl ether and ethylene glycol monobenzyl ether.

The proportion of the organic solvent in the cleaning fluid is not particularly limited and can be suitably selected to suit to a particular application, but is preferably from 10% to 60% by mass, more preferably from 20% to 60% by mass.

Water

The proportion of water in the cleaning fluid is not particularly limited and can be suitably selected to suit to a particular application, but is preferably from 10% to 90% by mass, more preferably from 20% to 60% by mass, for drying property and discharge reliability of the cleaning fluid.

Surfactant

Usable surfactants include silicone-based surfactants, fluorine-based surfactants, ampholytic surfactants, nonionic surfactants, and anionic surfactants.

The silicone-based surfactants are not particularly limited and can be suitably selected to suit to a particular application. In particular, those that do not decompose even at a high pH are preferred. Specific examples of the silicone-based surfactants include, but are not limited to, side-chain-modified polydimethylsiloxane, both-end-modified polydimethylsiloxane, one-end-modified polydimethylsiloxane, and side-chain-and-both-end-modified polydimethylsiloxane. In particular, those having a polyoxyethylene group and/or a polyoxyethylene polyoxypropylene group as the modifying group are preferred because they demonstrate good characteristics as an aqueous surfactant. Specific examples of the silicone-based surfactants further include polyether-modified silicone-based surfactants, such as a dimethyl siloxane compound having a polyalkylene oxide structure on a side chain which is bound to Si.

Specific preferred examples of the fluorine-based surfactants include, but are not limited to, perfluoroalkyl sulfonic acid compounds, perfluoroalkyl carboxylic acid compounds, perfluoroalkyl phosphate compounds, perfluoroalkyl ethylene oxide adducts, and polyoxyalkylene ether polymer compounds having a perfluoroalkyl ether group on a side chain, each of which has weak foaming property. Specific examples of the perfluoroalkyl sulfonic acid compounds include, but are not limited to, perfluoroalkyl sulfonic acid and perfluoroalkyl sulfonate. Specific examples of the perfluoroalkyl carboxylic acid compounds include, but are not limited to, perfluoroalkyl carboxylic acid and perfluoroalkyl carboxylate. Specific examples of the polyoxyalkylene ether polymer compounds having a perfluoroalkyl ether group on a side chain include, but are not limited to, a sulfate of a polyoxyalkylene ether polymer having a perfluoroalkyl ether group on a side chain, and a salt of a polyoxyalkylene ether polymer having a perfluoroalkyl ether group on a side chain. Specific examples of the counter ions for these fluorine-based surfactants include, but are not limited to, Li, Na, K, $NH_4$, $NH_3CH_2CH_2OH$, $NH_2(CH_2CH_2OH)_2$, and $NH(CH_2CH_2OH)_3$.

Specific examples of the ampholytic surfactants include, but are not limited to, laurylaminopropionate, lauryl dimethyl betaine, stearyl dimethyl betaine, and lauryl hydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan fatty acid esters, polyoxyethylene sorbitan fatty acid esters, and ethylene oxide adducts of acetylene alcohol.

Specific examples of the anionic surfactants include, but are not limited to, acetate, dodecylbenzene sulfonate, and laurate of polyoxyethylene alkyl ether, and polyoxyethylene alkyl ether sulfate.

Each of these surfactants can be used alone or in combination with others.

The silicone-based surfactants are not particularly limited and can be suitably selected to suit to a particular application. Specific examples thereof include, but are not limited to, side-chain-modified polydimethylsiloxane, both-end-modified polydimethylsiloxane, one-end-modified polydimethylsiloxane, and side-chain-and-both-end-modified polydimethylsiloxane. More specifically, polyether-modified silicone-based surfactants having polyoxyethylene group and/or polyoxyethylene polyoxypropylene group as the modifying groups are preferred since they demonstrate good characteristics as an aqueous surfactant.

These surfactants are available either synthetically or commercially. Commercial products are readily available from, for example, BYK Japan KK, Shin-Etsu Chemical Co., Ltd., Dow Corning Toray Co., Ltd., Nihon Emulsion Co., Ltd., and Kyoeisha Chemical Co., Ltd.

The polyether-modified silicone-based surfactants are not particularly limited and can be suitably selected to suit to a particular application. Examples thereof include, but are not limited to, a compound represented by the following general formula (S-1) that is a dimethylpolysiloxane having a polyalkylene oxide structure on a side chain which is bound to Si.

[Chem. 2]

GENERAL FORMULA (S-1)

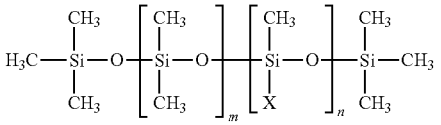

$X = -R(C_2H_4O)_a(C_3H_6O)_bR'$

In the general formula (S-1), each of m, n, a, and b independently represents an integer, R represents an alkylene group, and R' represents an alkyl group.

Specific examples of commercially-available products of the polyether-modified silicone-based surfactants include, but are not limited to: KF-618, KF-642, and KF-643 (available from Shin-Etsu Chemical Co., Ltd.); EMALEX-SS-5602 and SS-1906EX (available from Nihon Emulsion Co., Ltd.); FZ-2105, FZ-2118, FZ-2154, FZ-2161, FZ-2162, FZ-2163, and FZ-2164 (available from Dow Corning Toray Co., Ltd); BYK-33 and BYK-387 (available from BYK Japan KK); and TSF4440, TSF4452, and TSF4453 (available from Momentive Performance Materials Inc.).

Preferably, the fluorine-based surfactant is a compound having 2 to 16 fluorine-substituted carbon atoms, more preferably a compound having 4 to 16 fluorine-substituted carbon atoms.

Specific examples of the fluorine-based surfactants include, but are not limited to, perfluoroalkyl phosphate compounds, perfluoroalkyl ethylene oxide adducts, and polyoxyalkylene ether polymer compounds having a perfluoroalkyl ether group on a side chain. Among these, polyoxyalkylene ether polymer compounds having a perfluoroalkyl ether group on a side chain are preferred for their small foaming property. More specifically, compounds represented by the following general formula (F-1) or (F-2) are preferred as the fluorine-based surfactants.

[Chem.3]

$CF_3CF_2(CF_2CF_2)_m—CH_2CH_2O(CH_2CH_2O)_nH$ GENERAL FORMULA (F-1)

In the general formula (F-1), preferably, m is an integer of from 0 to 10 and n is an integer of from 0 to 40, for imparting water-solubility to the compound.

[Chem.4]

$C_nF_{2n+1}—CH_2CH(OH)CH_2—O—(CH_2CH_2O)_aY$ GENERAL FORMULA (F-2)

In the general formula (F-2), Y represents H, $C_mF_{2m+1}$ (where m represents an integer of from 1 to 6), $CH_2CH(OH)CH_2—C_mF_{2m+1}$ (where m represents an integer of from 4 to 6), or $C_pH_{2p+1}$ (where p represents an integer of from 1 to 19); n represents an integer of from 1 to 6; and a represents an integer of from 4 to 14.

The fluorine-based surfactants are available either synthetically or commercially. Specific examples of commercially-available products of the fluorine-based surfactants include, but are not limited to: SURFLON S-111, S-112, S-113, S-121, S-131, S-132, S-141, and S-145 (available from Asahi Glass Co., Ltd.); Fluorad™ FC-93, FC-95, FC-98, FC-129, FC-135, FC-170C, FC-430, and FC-431 (available from 3M Japan Limited); MEGAFACE F-470, F-1405, and F-474 (available from DIC Corporation); Zonyl (registered trademark) TBS, FSP, FSA, FSN-100, FSN, FSO-100, FSO, FS-300, and UR, and CAPSTONE FS-30, FS-31, FS-3100, FS-34, and FS-35 (available from The Chemours Company); FT-110, FT-250, FT-251, FT-4005, FT-150, and FT-400SW (available from NEOS COMPANY LIMITED); PolyFox PF-136A, PF-156A, PF-151N, PF-154, and PF-159 (available from OMNOVA Solutions Inc.); and UNIDYNE™ DSN-403N (available from Daikin Industries, Ltd.). Among these, FS-3100, FS-34, and FS-300 (available from The Chemours Company), FT-110, FT-250, FT-251, FT-4005, FT-150, and FT-400SW (available from NEOS COMPANY LIMITED), PolyFox PF-151N (available from OMNOVA Solutions Inc.), and UNIDYNE™ DSN-403N (available from Daikin Industries, Ltd.) are particularly preferred.

The proportion of the surfactant in the cleaning fluid is not particularly limited and can be suitably selected to suit to a particular application, but is preferably from 0.001% to 5% by mass, more preferably from 0.05% to 5% by mass.

Properties of Cleaning Fluid

Properties of the cleaning fluid are not particularly limited and can be suitably selected to suit to a particular application. As an example, preferred viscosity, surface tension, and pH thereof are described below.

Preferably, the viscosity of the cleaning fluid at 25 degrees C. is from 5 to 30 mPa·s, more preferably from 5 to 25 mPa·s. The viscosity can be measured at 25 degrees C. by a rotatory viscometer (RE-80L available from Toki Sangyo Co., Ltd.) equipped with a standard cone rotor (1°34'×R24), while setting the sample liquid amount to 1.2 mL, the number of rotations to 50 rotations per minute (rpm), and the measuring time to 3 minutes.

Preferably, the surface tension of the cleaning fluid is 35 mN/m or less, more preferably 32 mN/m or less, at 25 degrees C.

Preferably, the pH of the cleaning fluid is from 7 to 12, more preferably from 8 to 11, for preventing corrosion of metal materials that contact the cleaning fluid.

EXAMPLES

Further understanding of the present disclosure can be obtained by reference to certain specific examples provided herein below for the purpose of illustration only and are not intended to be limiting.

Preparation of Wipers

Each wiper was prepared by pasting the sheet-like nonwoven fabrics or films, shown in Table 1, as the first layer and the second layer. In Table 1, materials shown in the column of "FIBERS IN USE" are nonwoven fabrics except for those described as "film".

TABLE 1

| | WIPING SURFACE | | | | | | | |
|---|---|---|---|---|---|---|---|---|
| | MAXIMUM HEIGHT | MAXIMUM HEIGHT | VOID RATIO | | THICKNESS [nm] | | FIBERS IN USE | |
| WIPER NO. | OF WAVINESS Wz [μm] | OF ROUGHNESS Rz [μm] | FIRST LAYER | SECOND LAYER | FIRST LAYER | SECOND LAYER | FIRST LAYER | SECOND LAYER |
| 1 | 123 | 154 | 0.90 | 0.78 | 0.16 | 0.06 | RAYON | PET |
| 2 | 145 | 180 | 0.81 | 0.93 | 0.10 | 0.25 | PP | RAYON |
| 3 | 189 | 187 | 0.83 | 0.91 | 0.10 | 0.30 | PET | RAYON |
| 4 | 193 | 176 | 8.80 | 0.92 | 0.10 | 0.30 | PET | RAYON |
| 5 | 203 | 216 | 0.75 | 0.92 | 0.10 | 0.30 | PET | RAYON |
| 6 | 185 | 187 | 0.74 | 0.92 | 0.10 | 0.30 | PET | RAYON |
| 7 | 143 | 176 | 0.70 | 0.92 | 0.10 | 0.30 | PET | RAYON |
| 8 | 138 | 165 | 0.69 | 0.92 | 0.10 | 0.30 | PET | RAYON |
| 9 | 208 | 212 | 0.87 | 0.83 | 0.20 | 0.15 | PET | PP |
| 10 | 290 | 210 | 0.93 | 0.83 | 0.25 | 0.10 | RAYON | PET |
| 11 | 436 | 247 | 0.91 | 0.83 | 0.35 | 0.10 | RAYON | PET |
| 12 | 189 | 187 | 0.83 | 0.91 | 0.10 | 0.30 | PET | PP(40%) + RAYON(60%) |
| 13 | 193 | 176 | 0.80 | 0.92 | 0.10 | 0.30 + 0.10 | PET | RAYON + PET FILM |
| 14 | 93 | 131 | 0.78 | 0.91 | 0.06 | 0.19 | PET | PP |
| 15 | 87 | 164 | 0.78 | 0.93 | 0.06 | 0.54 | PET | PP |
| 16 | 697 | 547 | 0.93 | 0.78 | 0.54 | 0.06 | PP | PET |
| 17 | 170 | 210 | 0.88 | — | 0.56 | — | RAYON | — |

The maximum height of waviness Wz and the maximum height of roughness Rz of each wiper shown in Table 1 were measured by a laser microscope (LEXT OLS4100 available from OLYMPUS CORPORATION). First, a primary profile was acquired. The length of the primary profile to be evaluated in the measurement was 2.5 mm. Here, the primary profile refers to a curve constituting a part of a surface of the wiper, which is present on an orthogonal surface that is orthogonal to the conveying direction of the wiper, and which contacts the nozzle surface. The maximum height of waviness Wz was determined from a waviness profile obtained by cutting off short wavelength components from the primary profile under a profile filter condition of $\lambda c=80$ μm according to JIS B0601 (2013). The maximum height of roughness Rz was determined from a roughness profile obtained by cutting off long wavelength components from the primary profile under a profile filter condition of $\lambda c=80$ μm according to JIS B0601 (2013).

In Table 1, "PP" represents polypropylene, and "PET" represents polyethylene terephthalate. The fiber used for the second layer of the wiper 12 is a mixed fiber in which 40% by mass of PP and 60% by mass of rayon are mixed. The second layer of the wiper 13 is formed by pasting a PET film having a thickness of 0.1 nm to a rayon nonwoven fabric having a thickness of 0.3 nm. The wiper 17 has only the first layer and does not have the second layer.

Preparation of Cleaning Fluid

The following components were stirred with a magnetic stirrer for 30 minutes to prepare a cleaning fluid.

3-Methoxy-N,N-dimethylpropionamide (M100 available from Idemitsu Kosan Co., Ltd.): 50% by mass Dipropylene glycol monomethyl ether (available from Tokyo Chemical Industry Co., Ltd.): 8% by mass Silicone surfactant (WET-240 available from Nissin Chemical Industry Co., Ltd.): 1% by mass Ion-exchange water: balance Evaluation of Wiping Property for Removing Fixedly-Adhered Matter First, 0.1 ml of an ink (white ink for RICOH PRO AR manufactured by Ricoh Co., Ltd.) was dropped on a nozzle plate of an inkjet head (MH5440 manufactured by Ricoh Co., Ltd.), and the nozzle plate was left to stand for 15 hours. As a result, the ink got fixedly adhered to the nozzle plate. After the wiper shown in Table 1 was applied with the cleaning fluid at 20 μl/cm$^2$, the surface of the nozzle plate was wiped with the wiper. In the wiping operation, the pressing force was 3 N and the wiping speed was 50 mm/s.

Next, the nozzle plate was visually observed after the wiping operations, and the number of wiping operations performed until the fixedly-adhered ink had been removed was evaluated according to the following criteria. A, B, and C are acceptable for practical use, B is preferable, and A is more preferable. The results are shown in Table 2.

Evaluation Criteria

A: The wiping operation was performed 5 times or less until the fixedly-adhered ink had been removed.

B: The wiping operation was performed 6 to 7 times until the fixedly-adhered ink had been removed.

C: The wiping operation was performed 8 to 9 times until the fixedly-adhered ink had been removed.

D: The fixedly-adhered ink had remained even after performing the wiping operation 9 times.

Evaluation of Discharge Reliability

An ink (white ink for RICOH PRO AR manufactured by Ricoh Co., Ltd.) was mounted on the image forming apparatus illustrated in FIG. 1, having an inkjet head (MH5440 manufactured by Ricoh Co., Ltd.), and continuously discharged for 45 minutes. After a lapse of 30 minutes from termination of discharging, the nozzle surface of the ink discharge head was wiped with the wiping device illustrated in FIG. 3. Specifically, the wiper shown in Table 1 was applied with the cleaning fluid at 20 μl/cm$^2$, then the surface of the nozzle plate was wiped with the wiper. In the wiping operation, the pressing force was 3 N and the wiping speed was 50 mm/s.

Next, the ink was discharged again, and discharge reliability was evaluated according to the following evaluation criteria. A, B, and C are acceptable for practical use, B is preferable, and A is more preferable. The results are shown in Table 2.

Evaluation Criteria

A: No unstable discharging or non-discharging was observed.

B: Unstable discharging or non-discharging was observed at 2 or less nozzles.

C: Unstable discharging or non-discharging was observed at 3 to 5 nozzles.

D: Unstable discharging or non-discharging was observed at 5 or more nozzles.

TABLE 2

| | | EVALUATION RESULTS | |
|---|---|---|---|
| | WIPER NO. | WIPING PROPERTY | DISCHARGE RELIABILITY |
| EXAMPLE 1 | 1 | C | C |
| EXAMPLE 2 | 2 | B | B |
| EXAMPLE 3 | 3 | B | A |
| EXAMPLE 4 | 4 | A | A |
| EXAMPLE 5 | 5 | A | A |
| EXAMPLE 6 | 6 | B | A |
| EXAMPLE 7 | 7 | B | B |
| EXAMPLE 8 | 8 | C | C |
| EXAMPLE 9 | 9 | C | A |
| EXAMPLE 10 | 10 | C | A |
| EXAMPLE 11 | 11 | C | B |
| EXAMPLE 12 | 12 | B | A |
| EXAMPLE 13 | 13 | A | A |
| COMPARATIVE EXAMPLE 1 | 14 | A | D |
| COMPARATIVE EXAMPLE 2 | 15 | A | D |
| COMPARATIVE EXAMPLE 3 | 16 | D | D |
| COMPARATIVE EXAMPLE 4 | 17 | D | B |

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

This patent application is based on and claims priority to Japanese Patent Application No. 2018-242079, filed on Dec. 26, 2018, in the Japan Patent Office, the entire disclosure of which is hereby incorporated by reference herein.

REFERENCE SIGNS LIST

3 Carriage
4, 4*a*, 4*b* Recording head
4*n* Nozzle
20 Maintenance mechanism
20*b* Nozzle surface wiping mechanism
41 Nozzle surface
320 Sheet-like wiper
400 Pressing roller
410 Feed roller
420 Winding roller
430 Cleaning fluid dropping device
500 Foreign matter

The invention claimed is:

1. A wiper for wiping a nozzle surface of a liquid discharge head that discharges a liquid from a nozzle, comprising a plurality of layers including:

a first layer having a surface that contacts the nozzle surface, the surface having a maximum height of waviness Wz of from 100 to 600 μm, wherein the surface that contacts the nozzle surface has a maximum height of roughness Rz of from 170 to 500 μm.

2. The wiper according to claim 1, wherein the surface that contacts the nozzle surface has a maximum height of waviness Wz of from 150 to 300 μm.

3. The wiper according to claim 1, wherein the first layer has a void ratio of from 0.70 to 0.85.

4. The wiper according to claim 1, wherein the first layer has a void ratio of from 0.75 to 0.80.

5. The wiper according to claim 1, wherein the first layer has a thickness smaller than a total thickness of one or more of the layers other than the first layer.

6. The wiper according to claim 1, wherein the wiper has a thickness of from 0.1 to 3.0 mm.

7. A wiping device comprising the wiper according to claim 1.

8. The wiping device according to claim 7, further comprising a cleaning fluid to be applied to the nozzle surface.

9. The wiping device according to claim 8, further comprising a cleaning fluid container containing the cleaning fluid.

10. A liquid discharge apparatus, comprising:

a liquid discharge head having a nozzle surface, configured to discharge a liquid from a nozzle; and the wiping device according to claim 7.

11. The wiper according to claim 1, wherein the wiper is comprised of a nonwoven fabric, a woven fabric, a knitted fabric, or a porous body.

12. The wiper according to claim 1, wherein a void ratio of the first layer is smaller than a void ratio of at least one of the layers other than the first layer.

13. The wiper according to claim 1, wherein the wiper is comprised of a two-layer nonwoven fabric.

14. A wiping method, comprising:

wiping a nozzle surface of a liquid discharge head that discharges a liquid from a nozzle with a wiper, the wiper including a plurality of layers including:

a first layer having a surface that contacts the nozzle surface, the surface having a maximum height of waviness Wz of from 100 to 600 μm, wherein the surface that contacts the nozzle surface has a maximum height of roughness Rz of from 170 to 500 μm.

15. A wiper for wiping a nozzle surface of a liquid discharge head that discharges a liquid from a nozzle, comprising a plurality of layers including:

a first layer having a surface that contacts the nozzle surface, the surface having a maximum height of waviness Wz of from 100 to 600 μm, wherein the first layer has a void ratio of from 0.70 to 0.85.

* * * * *